US005687485A

United States Patent [19]

Shurtleff et al.

[11] Patent Number: 5,687,485

[45] Date of Patent: Nov. 18, 1997

[54] RAZOR HANDLE

[75] Inventors: Jill Marie Shurtleff, South Boston; Tzu-Jun Yen, Brookline, both of Mass.

[73] Assignee: The Gillette Company, Boston, Mass.

[21] Appl. No.: 648,466

[22] Filed: May 15, 1996

[51] Int. Cl.[6] ..... B26B 21/52

[52] U.S. Cl. ..... 30/526; 30/327; D28/47

[58] Field of Search ..... 30/526–533, 340; D28/47, 48, 46

[56] References Cited

U.S. PATENT DOCUMENTS

| | | | |
|---|---|---|---|
| D. 135,044 | 2/1943 | Buller | D28/48 |
| D. 240,569 | 7/1976 | Saito | D95/3 A |
| D. 241,080 | 8/1976 | Glaberson | D95/3 A |
| D. 241,179 | 8/1976 | Glaberson | D95/3 A |
| D. 241,583 | 9/1976 | Asano | D95/3 A |
| D. 242,661 | 12/1976 | Gray | D95/3 A |
| D. 243,419 | 2/1977 | Hedley | D28/48 |
| D. 249,968 | 10/1978 | Kiraly | D28/46 |
| D. 250,130 | 10/1978 | Douglas | D28/46 |
| D. 250,664 | 12/1978 | Kruger | D28/46 |
| D. 253,726 | 12/1979 | Schuman et al. | D28/46 |
| D. 254,692 | 4/1980 | Del Re | D28/46 |
| D. 259,065 | 4/1981 | Byrne | D28/46 |
| D. 260,944 | 9/1981 | Gray | D28/46 |
| D. 269,915 | 7/1983 | Iten et al. | D28/46 |
| D. 270,197 | 8/1983 | Gray | D28/48 |
| D. 277,987 | 3/1985 | Jacobson et al. | D28/48 |
| D. 279,613 | 7/1985 | Hannermann | D28/48 |
| D. 283,260 | 4/1986 | Alvarez | D28/48 |
| D. 293,036 | 12/1987 | Iten et al. | D28/48 |
| D. 304,773 | 11/1989 | Beuchat | D28/46 |
| D. 305,265 | 12/1989 | Motta et al. | D28/48 |
| D. 309,355 | 7/1990 | Shurtleff | D28/48 |
| D. 311,971 | 11/1990 | Faerber | D28/46 |
| D. 318,143 | 7/1991 | Wieneke | D28/46 |
| D. 319,893 | 9/1991 | Pittaway | D28/48 |
| D. 325,689 | 4/1992 | Gray | D28/48 |
| D. 327,550 | 6/1992 | Chen et al. | D28/48 |
| D. 345,232 | 3/1994 | Gray | D28/46 |
| D. 346,880 | 5/1994 | Meisner et al. | D28/48 |
| D. 352,568 | 11/1994 | Meisner et al. | D28/48 |
| D. 354,586 | 1/1995 | Grange | D28/46 |
| D. 355,049 | 1/1995 | Yasui | D28/48 |
| D. 364,707 | 11/1995 | Shurtleff | D28/46 |
| D. 365,419 | 12/1995 | Kamiya | D28/48 |
| D. 369,437 | 4/1996 | Armbruster et al. | D28/46 |

(List continued on next page.)

FOREIGN PATENT DOCUMENTS

| | | | |
|---|---|---|---|
| 0 418 726 A2 | 3/1991 | European Pat. Off. | B26B 21/52 |
| 0 615 820 A1 | 9/1994 | European Pat. Off. | B26B 21/52 |
| 27 01 271 | 7/1977 | Germany | 30/50 |
| 31 36 033A1 | 3/1983 | Germany | B26B 21/00 |
| M 93 00 457 | 10/1994 | Germany | 28/3 |
| M 9409079.3 | 6/1995 | Germany | 28/3 |
| DM/027 322 | 9/1993 | WIPO | 28/3 |

OTHER PUBLICATIONS

"Crazylegs Shaving Gel" advertisement, (S.C. Johnson &Son), *Mademoiselle* (Jul. 1972) p. 37.

"Wally Razor" ad in Roberta Fortune's Almanac p. 23 (undated prior art believed to be in 1995).

"Wally Razor" product package panels (undated prior art).

*Primary Examiner*—Douglas D. Watts

*Attorney, Agent, or Firm*—Edward S. Podszus

[57] ABSTRACT

A wet razor with improved ergonomic properties having an elongate handle shaft with a "Y" shaped yoke at the cartridge end, a bulbous proximal end and a finger orienting channel running down the spine of the handle ending at the bulbous end. The proximal end is bulbous in the direction traverse to the channel of the razor handle. The yoke bends down and laterally outward and the bulbous end bends down below the bottom surface of the handle, thus forming lateral and underside concave thumb and finger grips at foreward and rearward locations. The base of the yoke preferably has a finger rest to enhance steering the razor. The bottom of the razor has a series of pads depending from the upper surface for better gripping. The handle is suited for economical construction as a unitary plastics molding for female body shaving.

28 Claims, 4 Drawing Sheets

U.S. PATENT DOCUMENTS

| | | | |
|---|---|---|---|
| 1,117,953 | 11/1914 | Crandall . | |
| 2,583,057 | 1/1952 | Leatherman | 30/32 |
| 3,762,045 | 10/1973 | Fitzpatrick, Jr. | 30/40.1 |
| 4,212,103 | 7/1980 | Shuman-Hoole | 30/32 |
| 4,227,302 | 10/1980 | Torrance | 30/47 |
| 4,413,411 | 11/1983 | Trotta | 30/85 |
| 5,031,319 | 7/1991 | Althaus et al . | 30/85 |
| 5,402,573 | 4/1995 | Laniado | 30/41 |
| 5,497,551 | 3/1996 | Apprille, Jr. | 30/85 |

RAZOR HANDLE

BACKGROUND OF THE INVENTION

The present invention relates to a wet or safety razor having a handle, at the front end of which a shaving unit is disposed on a forward portion, and is directed more particularly to an ergonomically formed handle of a razor adapted for body shaving and suitable for use in a disposable safety razor, that is to razors in which the shaving unit having the blade or blades is permanently mounted to the razor so that the razor is discarded as a whole when the cutting edge of the (or each) blade has become dulled.

DESCRIPTION OF THE PRIOR ART

Wet razors are generally known that include a handle which mounts a razor blade unit disposed at a forward end of the handle.

A known razor is shown in German Design publication M 93 00 457 (Wilkinson Sword GmBH). A commercial product bearing a resemblance to the afore-mentioned reference is known to Applicants marketed in the United States under the trade designation "Silk Effects" by Schick-Warner Lambert Co. This razor has in top view a stubby hourglass shape with a waist and on top is convexly curved and smooth. The hemispherical rear portion forces the user to put that portion in the palm while the index finger extends beyond the head portion and is unavailable to guide or steer the razor.

Another known razor is shown in U.S. Pat. No. 5,031,319 (Althaus et al.), which discloses a handle having a compound S-shaped curved configuration in the longitudinal direction and having lateral sides that are symmetrically concave in cross section (see FIG. 5, at inset A) and upper and lower surfaces that are convex in cross section (see FIGS. 8–10). The convex upper and lower surfaces are shaped into an upwardly curving, partly hemispherical portion 4 which is variously convexly curved on its top and bottom surfaces. The Althaus patent discloses as its objective that the handle eliminates the degrees of freedom a user has to grasp the handle and forces the hand to a particular, defined position around its S-curve. A product resembling certain figures of the afore-mentioned reference is believed by Applicants to be available in the Canadian market under the trade designation "Protector" by Wilkinson Sword, Warner Lambert Canada Inc. The Protector handle disadvantageously allows fingers to slip from the smooth convexly curved top and bottom surfaces and to slip off the upwardly curved rear portion. The S-curve handle leads to the user constantly making compensating motions of the hand to rotate the razor about an axis through the blade edges, which leads to inconsistent shaving results and unsteady guidance of the razor.

Another known razor is shown in published European Patent Application 615 820 (Schwarz). Schwarz shows a handle that over most of its length is longitudinally curved with a constant radius of curvature. The outer surface is formed either flat or convex by a transverse cross-section that is rectangular or oval, respectively, and may have a rounded end (FIGS. 1, 2). Schwarz discloses that this curved handle forces the user to adopt and maintain a single, predetermined hand position during shaving.

Another known razor is shown in the the catalog Roberta Fortune's Almanac (1995 edition, at page 23) under the trade designation "Wally razor" by the company Hoke2, Campbell, Calif. The Wally razor is relatively broad, smooth and thin with a rear rounded portion and a hole in a foreward region for mounting on a hook. The handle is continuously curved longitudinally and formed of soft rubber which causes the handle to flex when gripped. Applicants are aware that the Wally razor is available in the United States through specialty retail channels for about $30. A user tends to hold the relatively broad top and bottom surfaces of the Wally razor, but the thin sides are relatively far apart and less convenient.

Another known razor is shown in U.S. Pat. No. 5,497,551 (Apprille, Jr.), issued Mar. 12, 1996, and assigned to the assignee of the present invention, in which a novel razor handle assembly is disclosed to be employed with a replaceable shaving unit for wet shaving. Commercial embodiments of these razors are available under the Sensor For Women trade designation from The Gillette Company. This disclosed structure has proved to be successful in achieving those objectives set forth in the patent, and has met with commercial success. The handle disclosed therein is a composite structure that provides a flat planar gripping portion that is substantially rigid and partially covered with a flexible elastomeric gripping portion. Some users may tend to hold the razor by the wide gripping regions on the planar upper and bottom surfaces between their fingers, rather than using the side surfaces or placement in the palm of the hand to steer the razor.

A problem of well known inexpensive disposable razors is that the razor handle is generally unstable during the shaving operation. The familiar T-handle razor has a handle which joins the razor head centrally thereof and extends transverse thereto with a straight, constant cross section such as circular or square. However, a problem with a T-handle is that it is difficult for the user to apply the razor to the area being shaved while maintaining an evenly distributed pressure along the length of the razor blade. A woman typically prefers to grasp an elongate razor handle along the sides, but conventional handle construction is such that the user's hand may fatigue because of the unnatural gripping position required by the handle construction, which is significant in the case of female shaving over various parts of the body because of the protracted period of time to complete the shaving operation. The handle portion is frequently textured in some manner to provide a gripping surface for the user, such texturing being particularly desirable because of slipperiness imparted to the handle resulting from contact of the handle with soap, water and lubricious shaving lotions during shaving.

SUMMARY OF THE INVENTION

The present invention provides a disposable razor which provides desirable ergonomic characteristics for the handle of a wet razor and provides a plurality of beneficially cooperating grasping and control surfaces for shaving various parts of the body with a comfortable grip and that is economical to manufacture.

In one aspect the invention features, in general, a razor handle suited for a disposable wet razor on which a shaving unit is mounted. The handle includes a forward portion that carries shaving unit mounting structure, a central elongate portion that has upper and lower surfaces and laterally opposed side surfaces, and a rearward portion that includes a bulbous thickened portion. The bulbous thickened portion is bent away from the side surfaces in a lateral direction with an approximate curvature of the thumb of the user to define opposed ergonomic lateral gripping indentations for the thumb and a finger to grasp opposed lateral surfaces of the bulbous portion, and a median plane of the bulbous portion is bent down towards the lower surface with a bottom portion of the bulbous portion bent away from the lower surface in the longitudinal direction with an approximate curvature of a thumb to define an ergonomic longitudinal gripping pad for the thumb and a finger to grasp opposed longitudinal surfaces of the bulbous portion. The upper is surface also has a longitudinally extending elongated orienting channel for a finger forward of the bulbous portion so that the user can place the bulbous portion in the palm and exert a centering and steering force on the orienting channel to controllably manipulate the razor handle. This is an advantageous grip position when a woman shaves the underarms and bikini area. Furthermore, the bulbous portion also provides, when pinched between the thumb and a finger either laterally or between upper and bottom surfaces, a stop to guard against the fingers slipping off the rear of the handle, which is advantageous when shaving the front as well as the backs of the legs.

The handle of the present invention may feature a generally straight central elongate portion generally quadrilateral in cross section, and the bulbous portion may be wider in a plan view than the principal handle width prevailing over the length of the handle. The forward portion can have a finger rest disposed forward of the bulbous portion so that the user places the bulbous portion in the palm of the hand and exerts a force on the finger rest to controllably manipulate the razor handle. The finger rest is preferably configured as a tongue extending above the top surface or it can be a recess. The central portion is preferably provided with ribs adjacent the orienting channel and extending along the lateral sides and partially to the lower surface to enhance finger gripping. The forward portion preferably is formed as two side arms which sweep laterally from a juncture with the central portion outward and extend forwardly and downwardly curved towards opposite sides of the shaving unit mounting structure, whereby the lateral swept sides have a concave contour for grasping by a finger and/or thumb. The forward portion can be comfortably pinched laterally between thumb and finger or with a thumb on the lower surface, which is another advantageous grip position when shaving underarms or the bikini area. The forward region bent towards the surface of the skin being shaved provides an extra amount of "reach" and helps ensure a useful working angle between the handle and the skin, which is especially useful when shaving such awkward areas as behind the knee and the ankle, which is furthest from the shoulder, without forcing the user to contort her body uncomfortably.

The handle is preferably formed as a unitary plastics molding, and the handle is cored out such that the lower surfaces of the central portion and bulbous portion are defined by the tips of cylindrical projections depending from the upper surface, thereby defining an effective tactile gripping surface on a handle with light weight and minimal use of material.

In a further specific embodiment, the center of gravity of the handle is disposed in a zone that is between one third and one half of the way from the rear of the handle. Thus, the center of gravity is located close to the palm when the bulbous end is placed in the palm of the hand. This provides for an improvement of the shaving result through an optimum handling of the handle by providing the center of gravity closer to the mass of the hand and further from the dynamically responding fingers which comfortably steer the razor.

BRIEF DESCRIPTION OF THE DRAWINGS

The foregoing and other features of the invention will be more particularly described in connection with the preferred embodiment, and with reference to the accompanying drawings, wherein.

DETAILED DESCRIPTION OF PREFERRED EMBODIMENTS

Figure 1:
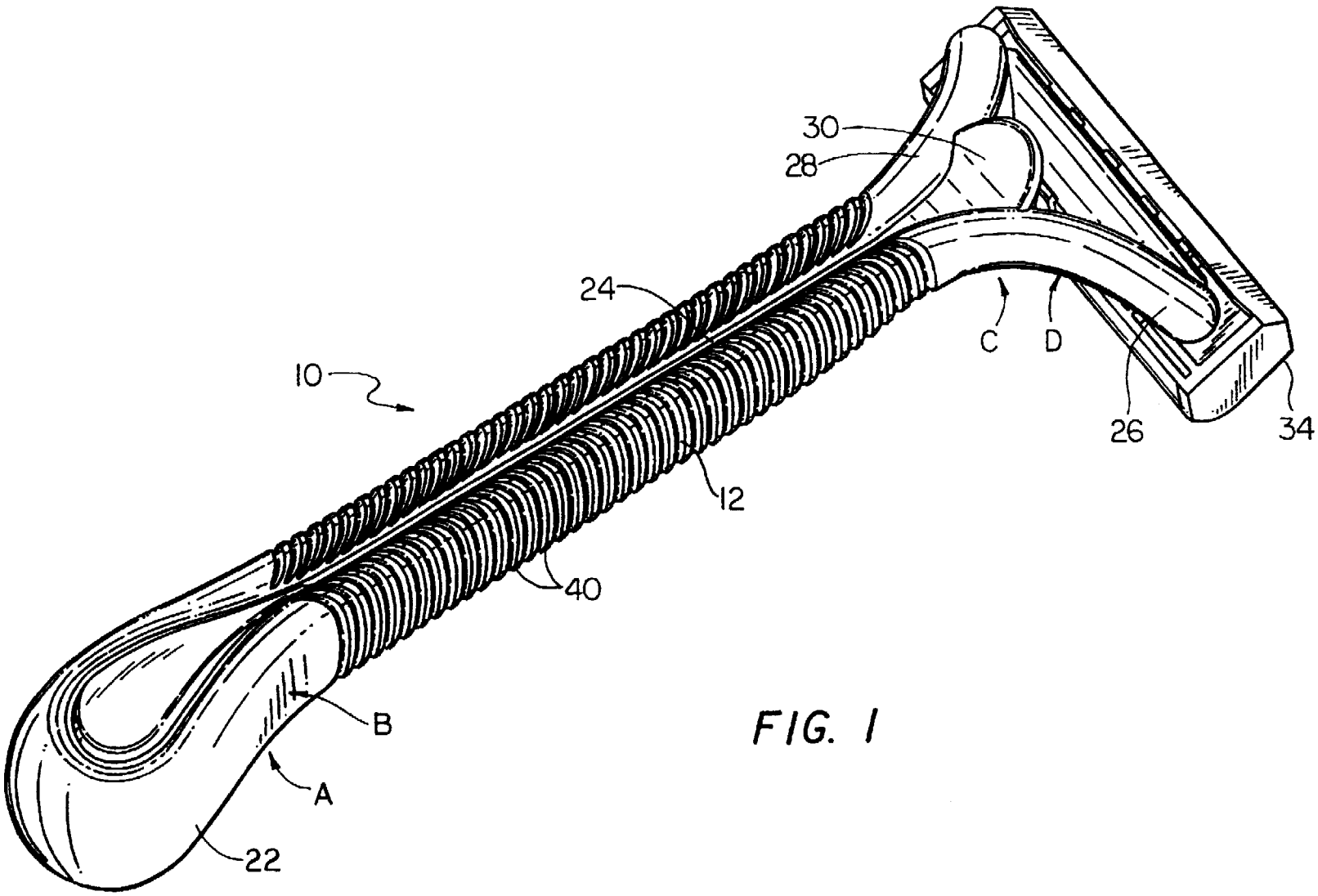
FIG. 1 is a top perspective view showing a safety razor constructed in accordance with the teachings of the present invention.
Figure 3:
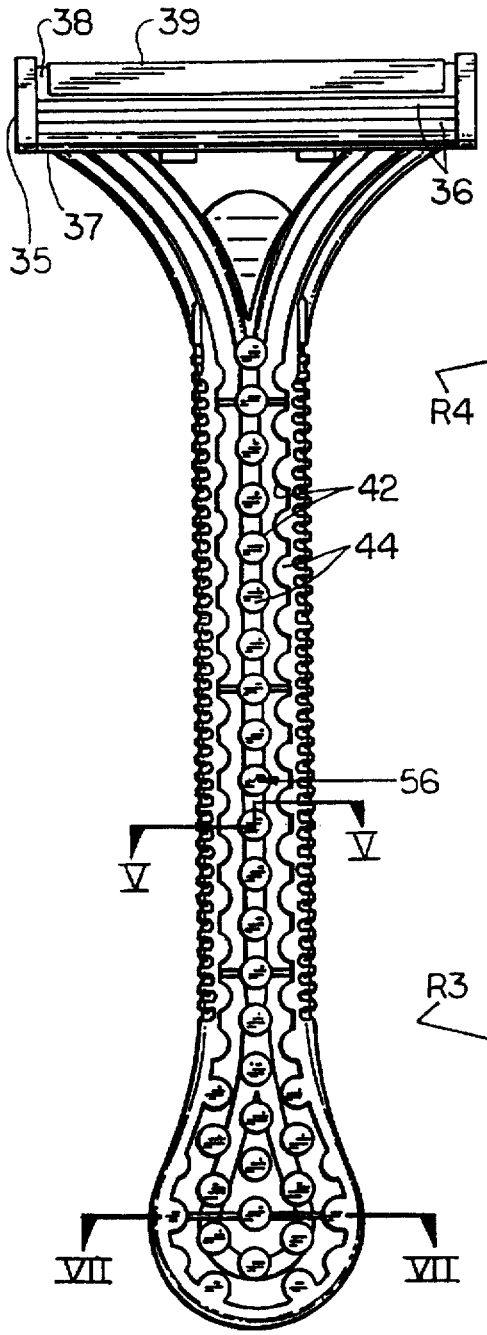
FIG. 3 is a bottom plan view showing further details of the razor handle of FIGS. 1 and 2.
Figure 2:
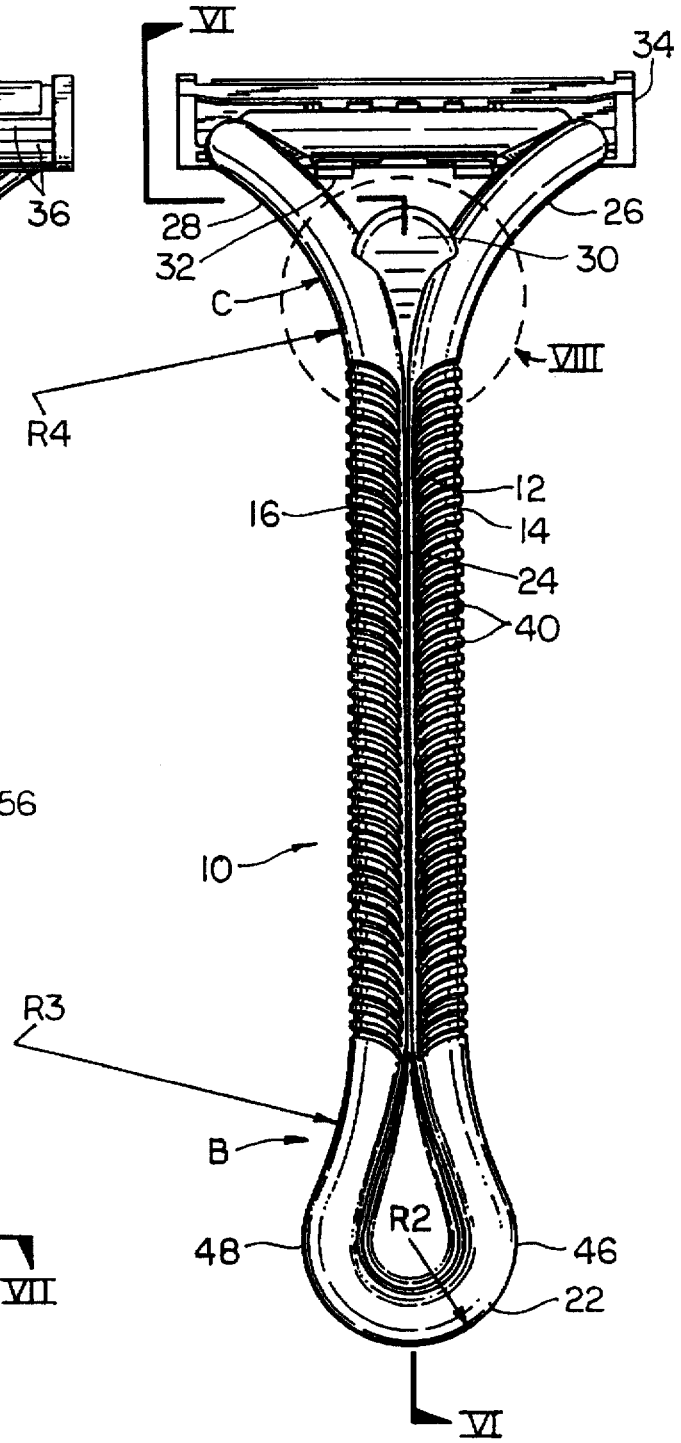
FIG. 2 is a top plan view showing the structure of FIG. 1 in about 1.5× scale.
Figure 4:
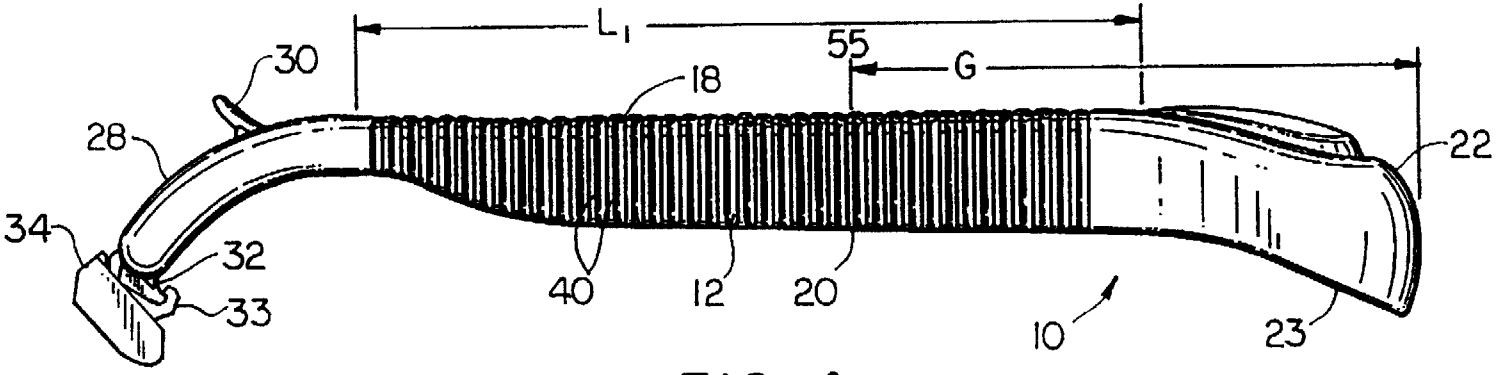
FIG. 4 is a side elevational view showing the structure of FIGS. 1 and 2.

Referring to FIGS. 1–5, FIG. 1 shows a perspective view of the razor. As best seen in FIGS. 2–4, the razor has a one piece handle 10 comprising an elongate central handle portion 12. Central portion 12 has lateral side surfaces 14, 16 and upper and lower surfaces 18, 20. Finger orienting channel 24 extends lengthwise along the center of upper surface 18 and terminates at the rear end of handle 10 where central portion 12 adjoins bulbous portion 22. Bulbous portion 22 is bulbous in the direction transverse to central portion 12 and also bends down below lower surface 20 of central portion 12. The forward portion of handle 10 is formed as a "Y"-shaped yoke comprising two curved arms 26, 28 which adjoin a forward area of the central portion 12. The two arms 26, 28 are curved laterally outward and downward to provide lateral finger orienting surfaces and a thumb rest underneath. Finger rest 30 is positioned approximately at the juncture of projecting arms 26, 28 with central portion 12. Handle 10 comprises at the forward end shaving unit mounting structure 32, preferably formed as rails, to which shaving unit 34 having mounting connect structure 33 is permanently mounted. Shaving unit 34 is mounted between projecting arms 26, 28. Central portion 12 has ribs 40 extending between orienting channel 24 and each of lateral sides 14, 16 and extending down the sides and continuing around the sides partially onto lower surface 20.

By the term "shaving unit" is meant a body having the skin-engaging shaving elements positioned thereon to set up the shaving geometry between the shaving elements, and includes a housing 35 having mounting connect structure 33, generally of plastics material, to which is secured, either fixedly or resiliently as is known in the art, one or more razor blades 36 between guard member 37 at the front and cap member 38 at the rear often having lubricating-strip cap portion 39. It is preferred to permanently mount shaving unit 34 relative to handle 10 so that the entire razor structure may be discarded at the end of its useful life. The coupling mechanism between the handle and the shaving unit desirably enables and is consistent with economical manufacture of razor components by molding techniques and provides a mechanically sturdy interconnection between the handle and the shaving unit. A simple structure is preferably provided by shaving unit 34 having fixed blades 36 and fixedly mounted on mounting structure 32 by mounting connect structure 33 in non-moveable relation to handle 10. Alternately, mounting structure 32 could be provided as a pivot joint with a biasing spring, where the pivot joint is formed either as a trunnion or a shell bearing for pivoting about a virtual pivot axis, and mounting connect structure 33 matingly formed, all as is well known in the art. Also alternately, shaving unit 34 can be formed to be releasablely coupled to handle mounting structure 32 to be exchanged for a fresh shaving unit when the blades are dulled, as is well known in the art.

Figure 5:
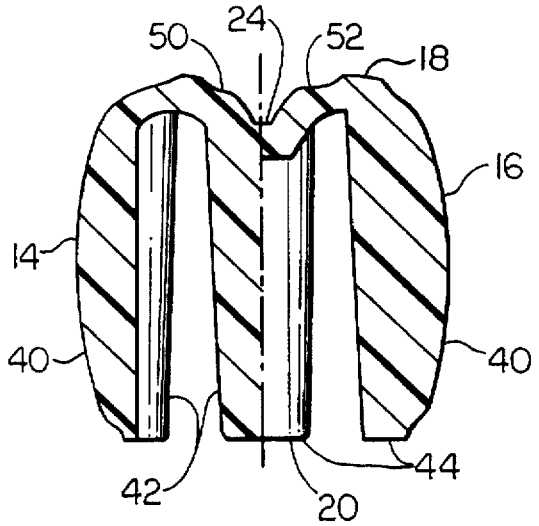
FIG. 5 is an elevational sectional view taken along the line V—V of FIG. 3.

As best seen in FIG. 4 the outermost surfaces of upper and lower surfaces 18, 20 and sides 14, 16 of handle elongate central body portion 12 intersect generally straight surfaces. As shown in FIG. 5, central portion 12 in cross section presents outer surfaces intersecting a roughly quadrilateral shape with rounded edges. The length of handle 10 overall as seen in FIG. 2 is about 117 mm, and the length of handle 10 with shaving unit 34 is about 119–120 mm. As shown in FIGS. 4–5, central portion 12 has a length L1 of about 70 mm and has width of principally 9.5 mm over the major portion of its length between opposed side surfaces 14, 16 and a height of principally 9.5 mm over the major portion of its length between upper and lower surfaces 18, 20.

Figure 6:
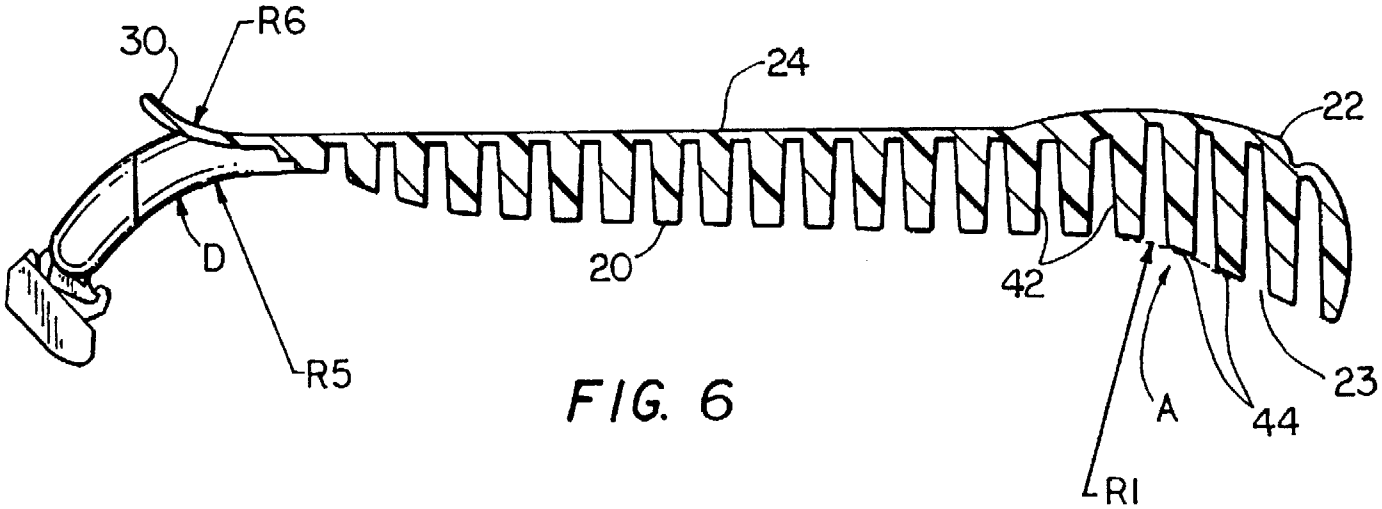
FIG. 6 is an elevational sectional view taken along the line VI—VI of FIG. 2.
Figure 7:
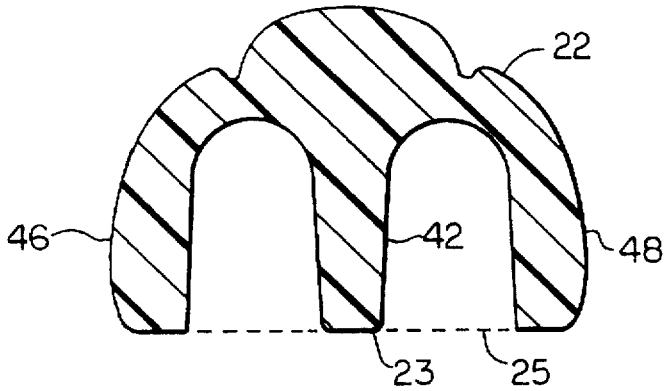
FIG. 7 is sectional view taken along the line VII—VII of FIG. 3.

As shown in FIG. 3 and in cross section in FIGS. 5, 6 and 7, lower surface 20 is formed by a series of pin-shaped projections 42 depending from upper surface 18 and which are shaped either cylindrical or half-cylindrical where they intersect side surfaces 14, 16 as well as portions of ribs 40 extending onto lower surface 20. Distal tips 44 of projections 42 collectively define lower surface 20 and bottom surface 23 of bulbous portion 22. Distal tips 44 provide a pleasant tactile feel and a satisfying gripping surface for the finger or thumb of the user. Projections 42 provide a visually complete article that conveys a sense of "handle heft" and avoids a large void or cored-out section, while permitting minimal use of material by forming handle 10 as a lightweight, one-piece plastics molding.

As shown in FIGS. 4 and 6, bulbous portion 22 distinctly bends down away from upper surface 18. In particular, bulbous portion 22 has bottom surface 23 disposed lower than lower surface 20 of central portion 12. Bulbous portion 12 bends down from surface 20 at a radius R1 of about 27.3 mm to form rear underside thumb support position "A". As shown in FIG. 2, bulbous portion 22 has side walls 46, 48 extending transversely outward and intersecting along a droplet-shaped radius R2 of about 19 mm (in plan view), side walls 46, 48 bending distinctly away from each respective opposed lateral side surfaces 14, 16 with a radius R3 of about 34 mm (in plan view) to form rear lateral thumb and finger support positions "B". The distinct departure of surfaces of bulbous portion 22 from respective adjoining surfaces of central portion 12 provide lateral as well as underside curved thumb support positions "A" and "B" that are distinct from surfaces 14, 16 and 20 and that can be located by the thumb of a user simply by feel. Bulbous portion 22 is comfortably placed in the palm and acts as a stable pivot for rotation of handle 10 when the user grasps lateral sides 14, 16 or places her finger in orienting channel 24 or on finger rest 30 to steer handle 10, as more fully described below. Bulbous portion 22 furthermore acts as a stop to retard the hand slipping off a wet, soapy razor handle, which is especially useful when the razor is gripped at the rear and used for long stroke shaving as in shaving the legs. Bottom surface 23 is defined by the collective tips 44 in the region of bulbous portion 22. As seen in FIG. 7 in cross section, bottom surface 23 of bulbous portion 22 can in the transverse direction be formed as a flat portion 25 approximately even with side walls 46, 48, which simplifies construction of a mold tool. Alternatively, bottom surface 23 can be formed concave, for example by having projections 42 in a central region thereof shorter than laterally opposed side walls 46, 48 of bulbous portion 22. Forming the bottom surface 23 of projections 42 rather than as a solid surface advantageously contributes to a user sensing a thumb-conforming surface in longitudinal and lateral directions since the fleshy part of the thumb can deform slightly between tips 44 of projections 42.

As shown in FIGS. 2 and 6, the forward portion of handle 10 which supports shaving unit 34 comprises bent sides 26, 28, which bend distinctly laterally outward from respective lateral surfaces 14, 16 and arch downwardly from lower surface 20 of central portion 12. Arms 26, 28 bend away from respective opposed lateral surfaces 14, 16 with a radius R4 of about 30.5 mm (in plan view) to form foreward lateral thumb and finger support positions "C". As seen in FIG. 6, arms 26, 28 arch down in the longitudinal direction at a radius R5 of about 18 mm (side elevational view) to form foreward underside thumb support position "D". Arms 26, 28 thus form distinct foreward lateral as well as underside curved thumb and finger support positions "C" and "D" that can be located by the thumb and fingers of a user simply by feel. Arms 26, 28 extend laterally outward to a width about 37 mm therebetween, thereby permitting the user to balance applied shaving force over the entire length of shaving unit mounting structure 32. This permits the user to apply more balanced forces to shaving unit 34 than using a conventional disposable "T"-handle razor. The downward arch of arms 26, 28 in the longitudinal direction provides more "reach", which especially assists the user in comfortably reaching areas of the skin to be shaved when her arm is already extended.

This helps avoid the necessity of having to uncomfortably rotate the hand at an awkward angle to present shaving unit 34 to the skin, which is especially useful behind the knee and at the ankle, where the hand is positioned furthest from the shoulder. Without the downward arch of arms 26, 28, the user would have to stretch her arm an additional amount to obtain a useful working angular relationship between handle 10 and blades 36

As shown in FIG. 2 and in FIG. 5 in cross section, centrally located finger orienting channel 24 provides the user a tactile indication of the center of handle 10. A finger placed in orienting channel 24 advantageously applies steering control to center the razor and assists fine motor coordination to pivot the razor about its longitudinal axis. Orienting channel 24 is at a depth of about 1–2 mm, preferably about 1.5 m, below the outermost portion of upper surface 18 between left and right humps 50, 52 which receive a finger therebetween and to which the finger can apply fine motor control forces. Women like to place a finger on upper surface 20 of the razor to bear down on shaving unit 34 while shaving, and since orienting channel 24 extends substantially the length of central portion 12, orienting channel 24 is accessible to be manipulated over a continuous range of hand holding positions and can accommodate different sized hands. Because orienting channel 24 provides a tactile indication of its location and because it can receive a finger, it is especially helpful when a woman navigates the razor in areas in which she cannot easily see the razor, such as the underarms and behind the legs.

Figure 8:
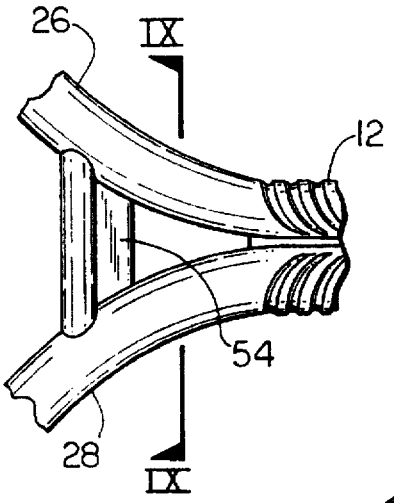
FIG. 8 is a partial elevational view showing an alternate construction detail taken along arrow VIII of FIG. 2.

As best shown in FIGS. 2, 4 and 6, finger rest 30 is located approximately at the juncture of arms 26, 28 with central portion 12. Finger rest 30 is preferably formed as a tongue-like projection curved at a radius R6 of about 7 mm from, and extending about 2 to 3 mm above, upper surface 20. Finger rest 30 provides a point of force application for a finger, particularly an index finger, to apply a steering force as well as to stabilize handle 10. Finger rest 30 is located to permit bulbous portion 22 to be placed in the palm while a finger applies control to finger rest 30. Alternatively, as shown in detail in FIGS. 8 and 9 finger rest 30 can be formed as a recess 54 below upper surface 20, the remainder of the structure in FIGS. 8 and 9 being as in FIGS. 1–7.

As best shown in FIGS. 2 and 3, a series of spaced ribs 40 projects from each of lateral sides 14, 16 of central portion 12. Ribs 40 cover substantially the entire length of central portion 12. Ribs 40 extend along substantially the entire width of each lateral side surface 14, 16 preferably transverse to the longitudinal axis of handle 10 to retard slippage of a wet, soapy handle when held in the hand. Ribs 40 extend from the lateral sides 14, 16 over humps 50, 52 (shown in FIG. 5) to the margin of orienting channel 24. Ribs 40 adjacent orienting channel 24 can be perpendicular to a direction of pulling along the longitudinal axis or preferably partially perpendicular to the longitudinal axis, which provides sufficient resistance to handle slippage and a pleasing aesthetic appearance and also assists drawing the finger into orienting channel 24 to center the razor. Ribs 40 wrap around lateral sides 14, 16 partially onto lower surface 20 to enhance fine motor control over lower surface 20 as well.

As shown in FIGS. 3 and 4, handle 10 has center of gravity 55 located longitudinally in a zone that is between one third and one half of the way foreward from the rear of the handle. As shown in FIG. 4, center of gravity 55 is located a distance G of about 52 mm (in plan view) from the end of bulbous portion 22 Considering the longer combined handle 10 and shaving unit 34, the distance G to the center of gravity is about 60 mm. Thus, center of gravity 55 is located close to the palm when the bulbous end is placed in the palm of the hand gripping bulbous portion 22. This ergonomically provides center of gravity 55 functionally close to the mass of the hand, which does not interfere with large motion movement of the hand or encourage fatigue, while optimizing the dynamic response ability of the fingers, which are located further away, to steer the razor with greater comfort.

Figure 9:
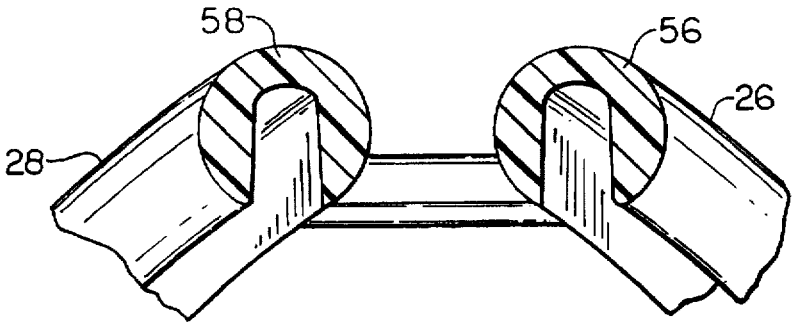
FIG. 9 is an elevational sectional view taken along the line IX—IX of FIG. 8.

In a particular embodiment as best shown in FIGS. 3, 5 and 9, curved arms 26, 28 are formed of members 56, 58 having a partially tubular cross-sectional wall construction. Tubular members 56, 58 extend straight and closely parallel to form elongate central portion 12, while adjacent wall portions of tubular members 56, 58 form orienting channel 24 between their tangency. The open tubular shape has sufficient moment of inertia to provide the desired structural rigidity to handle 10 while being consistent with economic production of a unitary plastics molded part having minimum material and light weight.

Applicants'invention provides multiple finger, thumb and hand gripping and pivoting structures on an ergonomically friendly and lightweight elongate handle designed for the needs of users who prefer disposable razors. Disposable "T"-shaped handle razors are popular especially with female users who prefer to grasp lateral sides of a handle because these handles are typically made with an effort to minimize the amount of plastics in order to keep costs low, therefore providing the consumer a product that she can throw away without feeling that much money has been expended or that much discarded plastic will burden the environment. These users are resistant to premium-type handle systems that typically are constructed of multiple parts, more plastics material and are more expensive, and comprise a consumer group with distinct demands.

Applicants' invention assists shaving body surfaces which include sensitive body areas and or which are relatively complex in shape and difficult to shave by providing a variety of cooperating finger, thumb and hand gripping and pivoting structures. For shaving the legs, a woman may advantageously hold the handle at central portion 12 or more rearward at bulbous portion 22 at the lateral grip regions "B" between a thumb and finger. Bulbous portion 22 can be placed stablely in the palm and a thumb and finger applied to slip retarding ribs 40 on lateral surfaces 14, 16 while applying a steering force to orienting channel 24 anywhere along its length or to finger rest 30. The ability of orienting channel 24 to provide centering is especially useful in shaving legs because of the long reach and extended grasp required, and thus the fingers cannot be choked up on handle 10 behind shaving unit 34 to provide control. Bulbous portion 22 at lateral and underside regions "A" and "El" provides a stop surface in case the hand wanders back in the wet, soapy environment and might otherwise pull away from handle 10. Underside region "A", which is provided with pad-like gripping projections 44, may be used as a thumb and finger pinch for shaving the back sides of legs, while the forward arms 26, 28 are bent to access difficult to reach areas such as ankles. For shaving the underarms and bikini area, the woman may advantageously place bulbous portion 22 in the palm to steady handle 10 and rest thumb and finger on the foreward lateral concave contoured regions "C". Alternately, the user could choke up on handle 10 near shaving unit 34 by wrapping fingers and thumb into concave contoured regions "C" and onto central portion 12, or alternately pinch the arched underside "D" and pad-like gripping projections 44 of undersurface 20 with a thumb below and a finger above in orienting channel 24.

While a particular embodiment of the invention has been shown and described, modifications thereof will be apparent to those skilled in the art, and therefore it is not intended that the invention be limited to the disclosed embodiment, or to details thereof, and departures may be made therefrom within the spirit and scope of the present invention and the appended claims.

We claim:

1. A razor handle comprising:

a forward portion further comprising a cartridge mounting structure, a rearward portion remote from the forward portion, and a central elongate handle member disposed between the forward and rearward portions having an upper surface and a lower surface and a longitudinal axis disposed therebetween, and first and second laterally opposed side surfaces having a lateral axis therebetween transverse to the longitudinal axis, wherein the rearward portion further comprises a bulbous thickened portion bent away from the side surfaces in a direction along the lateral axis with an approximate curvature of the fleshy part of a thumb of the user forming opposed ergonomic lateral gripping indentations for the thumb and a finger of the hand of the user to grasp opposed lateral surfaces of the bulbous portion, and wherein a median plane of the bulbous portion is bent away from the upper surface in a direction of the lower surface and the bulbous portion further comprises a bottom surface bent away from the lower surface in a direction along the longitudinal axis with the approximate curvature of the fleshy part of the thumb of the user forming an ergonomic longitudinal gripping pad for the thumb and a finger of the hand of the user to grasp opposed longitudinal surfaces of the bulbous portion, and wherein the upper surface further defines at a location forward of the bulbous portion a longitudinally extending elongated orienting channel for a finger of a user, whereby the user places the bulbous portion in a palm of the hand and exerts a force on the elongate finger orienting channel with the finger of the hand to controllably manipulate the razor handle.

2. A razor handle according to claim 1, wherein the longitudinal axis lies in a generally flat central longitudinal plane.

3. A razor handle according to claim 1, wherein the first and second laterally opposed side surfaces define a principal handle width therebetween along the lateral axis and the bulbous portion has a width greater than the principal handle width.

4. A razor handle according to claim 1, wherein the elongate finger orienting channel extends over a major portion of the upper surface between the finger rest and the bulbous thickened portion.

5. A razor handle according to claim 1, wherein the forward portion further comprises a finger rest disposed rearward of the cartridge mounting structure.

6. A razor handle according to claim 5, wherein the finger rest is spaced forward of the bulbous portion so that the user places the bulbous portion in the palm of the hand and exerts a force on the finger rest with a finger of the hand to controllably manipulate the razor handle.

7. A razor handle according to claim 6, wherein the finger rest extends above the upper surface.

8. A razor handle according to claim 6, wherein the upper surface further defines a recess forming the finger rest.

9. A razor handle according to claim 1, wherein the upper surface further comprises a plurality of finger gripping ribs adjacent the elongate finger orienting channel and extending at least partially transverse to the longitudinal axis.

10. A razor handle according to claim 9, wherein at least one side surface further comprises a textured gripping surface proximate the elongate finger orienting channel.

11. A razor handle according to claim 10, wherein the textured gripping surface extends from the at least one side surface at least partially to the lower surface.

12. A razor handle according to claim 1, wherein the forward portion further comprises at least one lateral sweep portion adjoining one of the first and second side surfaces and disposed between the elongate member and the cartridge mounting structure and having a concave contour for a finger, the lateral sweep portion being concave relative to a location laterally outward from the elongate handle member and swept in a direction along the longitudinal axis.

13. A razor handle according to claim 12, wherein the forward portion further comprises two opposed lateral sweep portions extending towards opposite sides of the cartridge mounting structure.

14. A razor handle according to claim 1, wherein a median plane of the forward portion is bent away from the upper surface and the forward portion is disposed at least partially below the elongate member lower surface.

15. A razor handle according to claim 14, wherein the lower surface curves in a direction of the longitudinal axis upward towards the central longitudinal plane in a region of intersection with the forward portion bent away from the upper surface, whereby a user places a thumb in the region of intersection and a finger in the finger orienting channel to controllably manipulate the razor handle.

16. A razor handle according to claim 1, wherein the bulbous portion bottom surface in a direction of the lateral axis is provided with a flattened portion.

17. A razor handle according to claim 1, wherein at least one of the upper and lower surfaces is at least partially formed by a plurality of adjacent projections extending from the other of the surfaces, wherein a locus of distal ends of the projections collectively define the at least one surface.

18. A razor handle according to claim 17, wherein the lower surface is defined by the distal surfaces of the projections depending from the upper surface.

19. A razor handle according to claim 17, wherein the handle is a one piece plastics molding.

20. A razor handle according to claim 1, wherein the forward portion further comprises two laterally spaced, at least partially in cross-section tubular, wall members and the central elongate member further comprises portions of the tubular members extending closely adjacent along the longitudinal axis and defining therebetween the elongate finger orienting channel.

21. A razor handle according to claim 1 which has a center of gravity that is disposed in the region between a rearward third of the handle and the halfway point thereof.

22. A razor handle according to claim 1 in combination with a shaving unit.

23. A razor handle according to claim 22 wherein the cartridge mounting structure permanently mounts the shaving unit.

24. A handle for a wet razor comprising:

an elongate handle member bent at a forward end and at an opposed rearward end towards the surface of the skin of a user being shaved in the shaving position and having a generally elongate central region between said forward and rearward ends, said handle member having a first principal surface, an opposed second principal surface and opposed lateral side surfaces, wherein said handle member further comprises a cartridge mounting structure provided at said forward end and a longitudinally extending elongated orienting channel for a finger of a user provided at said central region disposed in said first principal surface, and said bent rearward end further comprises a bulbous thickened portion extending as projected onto a plane parallel to said first principal surface, in a direction transverse to said elongated channel with a width generally greater in a direction transverse to the longitudinal axis than said central region, said bulbous portion being bent away from said second principal surface forming an ergonomic gripping pad for the curved fleshy part of a thumb and a finger of the hand of the user grasp the bulbous portion, whereby a user places said bulbous portion in a palm of the hand and exerts a force on said elongate finger orienting channel with a finger of the hand to controllably manipulate said razor handle.

25. A razor handle according to claim 24, wherein said first principal surface further defines a finger rest disposed rearward of said cartridge mounting structure and disposed forward of said bulbous portion so that the user places the bulbous portion in the palm of the hand and exerts a force on the finger rest with a finger of the hand to controllably manipulate said razor handle.

26. A razor handle according to claim 24, wherein said forward portion is laterally curved as viewed in a direction of said first principal surface away from said lateral sides towards opposite lateral regions of said cartridge mounting structure.

27. A razor handle according to claim 24, wherein said elongate central region has a longitudinal axis lying generally in a plane.

28. A razor handle according to claim 24 in combination with a shaving unit.

* * * * *